US007658220B2

(12) United States Patent
Yates

(10) Patent No.: US 7,658,220 B2
(45) Date of Patent: Feb. 9, 2010

(54) BARRIER MEANS

(75) Inventor: Adam Yates, Harrogate (GB)

(73) Assignee: Lindam Limited, Harrogate (GB)

( * ) Notice: Subject to any disclaimer, the term of this patent is extended or adjusted under 35 U.S.C. 154(b) by 252 days.

(21) Appl. No.: 11/599,805

(22) Filed: Nov. 15, 2006

(65) Prior Publication Data

US 2007/0144691 A1 Jun. 28, 2007

(30) Foreign Application Priority Data

Nov. 16, 2005 (GB) ..... 0523333.3

(51) Int. Cl.
*A47G 5/00* (2006.01)

(52) U.S. Cl. ..... 160/377; 49/55; 49/57; 49/465

(58) Field of Classification Search ..... 160/377, 160/355, 372; 403/109.3; 49/55, 57, 465; 248/354.5; 410/105.3, 123
See application file for complete search history.

(56) References Cited

U.S. PATENT DOCUMENTS 3,351,359 A * 11/1967 Ferraris ..... 285/7
5,657,809 A * 8/1997 Longoria et al. ..... 160/369
5,782,039 A * 7/1998 Scherer et al. ..... 49/465
6,056,038 A * 5/2000 Foster et al. ..... 160/351
6,247,882 B1 * 6/2001 Huang ..... 410/151
6,474,021 B2 * 11/2002 Homeyer ..... 49/57
7,422,048 B2 * 9/2008 Andersen ..... 160/377

FOREIGN PATENT DOCUMENTS

WO WO2004/079142 A1 9/2004

* cited by examiner

*Primary Examiner*—Blair M. Johnson
(74) *Attorney, Agent, or Firm*—Head, Johnson & Kachigian

(57) ABSTRACT

Barrier means are provided having a frame including a plurality of frame members, movable between a first substantially erect condition and a second substantially folded condition. At least one of the frame members including two or more telescopically mounted portions capable of relative movement to allow expansion and/or contraction of the length of the frame member. Locking means are associated with one or more of said frame portions to allow the portion or portions to be locked at a required length. The locking means are movable between the locked and/or unlocked position by relative movement of the frame portion or portions with which the locking means are associated.

26 Claims, 7 Drawing Sheets

BARRIER MEANS

CROSS-REFERENCE TO RELATED APPLICATIONS

This application claims priority to British Patent Application No. 0523333.3 filed 16 Nov. 2005.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY REFERENCE OF MATERIAL SUBMITTED ON A COMPACT DISC

Not Applicable

BACKGROUND OF THE INVENTION

1. Field of the Invention

This invention relates to barrier means, and particularly barrier means which are capable of being moved between an erect condition and a substantially folded condition.

Although the following description refers almost exclusively to barrier means in the form of a child safety gate, it will be appreciated by persons skilled in the art that the barrier means could be used in any suitable doorway or frame defining an opening which is to be selectively closed to act as a barrier against any suitable object, force, person, animal and/or the like.

Conventional child safety gates typically include a rigid outer frame with a plurality of bar members located therebetween to act as a barrier to prevent a person, animal and/or the like from passing the gate without the gate first being opened. In order to allow the gate to be fitted into different sized doorways or frames, the gate can be provided with extension bars which are removably located at one or more ends of the gate to increase or decrease the width of the same. In addition or as an alternative, one or more friction blocks can be provided adjacent the ends of the gate and the friction blocks can be moved relative to the gate using one or more rotatable screws. The friction blocks can be moved into and out of engagement with the doorway or frame to engage or release the gate therefrom. A problem with such conventional gates is that they are relatively large and heavy and are not easy to transport. As such, when a young child or pet is taken to a new house for example, such as a holiday home, there is often no suitable safety gate arranged in a door way in which the animal or child is to have restricted access or exit from.

2. Description of the Related Art

In order to overcome the above problem, it is known to provide child safety gates which can be moved between substantially folded and erect conditions. An example of such a child safety gate is disclosed in WO2004/079142. The gate has an outer frame comprising two cross members and two lateral posts with flexible fabric located therebetween. The ends of the cross members joining the ends of the lateral posts are hingedly connected. Each of the two lateral posts include two portions which are hingedly connected together at adjacent ends thereof, thereby allowing the lateral posts to fold at a point substantially centrally along the lengths thereof. The hinges of opposite lateral posts are moved towards each other when collapsing the gate, thereby causing the lateral posts to pivot relative to the cross members and move the two opposing cross members towards each other to fold the gate. Each cross member includes two telescopically mounted cross member portions and these portions are slidable relative to each other to allow the width of the gate to be adjusted to fit different sized doorways. In order to lock the telescopically mounted portions in a required position, a pin is provided on the inner portion which is resiliently biased to protrude outwardly from the inner portion. When the pin on the inner portion is aligned with an aperture located on the outer portion, the pin engages in the aperture to lock the frame portions in the required position. In order to release this engagement, a user depresses the pin and moves the frame portions to the required position.

BRIEF SUMMARY OF THE INVENTION

A problem with conventional foldable child safety gates is that it can be difficult to erect the gate and adjust the cross members to the required length at the same time, particularly if the gate is heavy.

It is therefore an aim of the present invention to provide barrier means which are more easily moved between an erect condition and a folded condition.

It is a further aim of the present invention to provide a method of using barrier means.

According to a first aspect of the present invention there is provided barrier means, said barrier means having a frame including a plurality of frame members movable between a first substantially erect condition and a second substantially folded condition, at least one of said frame members including two or more telescopically mounted portions capable of relative movement to allow expansion and/or contraction of the length of the frame member, and locking means associated with one or more of said frame portions to allow the portion or portions to be locked at a required length, characterized in that the locking means are movable between the locked and/or unlocked position by relative movement of the frame portion or portions with which the locking means are associated.

Thus, the present invention provides a self releasing and self locking mechanism on the barrier means which only requires relative movement of the frame portions associated with the locking means to move or actuate the lock between locked and unlocked positions. As such, a user is not required to manually manipulate the locking means directly, thereby freeing their hands for controlling movement of and for supporting the barrier means. This significantly increases the ease with which the barrier means can be moved between erect and folded or collapsed conditions.

The locking means can be self releasable or self lockable simply by applying a minimum pre-determined level of force to move the frame portions relative to each other.

Preferably, the frame portions are capable of undergoing rotational and/or sliding movement relative to each other in use.

Preferably, the locking means includes a locking bar provided on or associated with one of the frame portions, at least a part of which engages in a recess or aperture located on or associated with the other adjacent frame portion.

The locking bar is typically located on or associated with an outer frame portion having larger dimensions and in which an inner frame portion having smaller dimensions is telescopically mounted. The one or more apertures and/or recesses are typically provided on the inner, smaller dimensioned frame portion.

Preferably, the locking means or locking bar is resiliently biased to an engaged or locked position. The resilient biasing means typically includes a spring, sprung material and/or the like.

Further, preferably, the locking bar is pivotably mounted on said frame portion to allow pivotable movement of said bar between said locked and unlocked positions.

In one embodiment, the locking bar is provided on an outer frame portion and has a first end which engages with an inner frame portion, a second end which has a resilient biasing force against thereon and an intermediate portion between the ends which is pivotably mounted to the outer frame portion.

Preferably, the engaging portion or first end of the locking bar is provided with a taper narrowing towards the engaging part and the tapered end is engageable in one or more apertures and/or recesses on the other frame portion.

Further, preferably, the tapered portion or end is shaped so as to preferentially engage with an aperture and/or recess when approaching the aperture or recess from a first direction, but preferentially disengage with the aperture and/or recess when approaching from an opposite direction. Thus, for example, the engaging portion of the locking bar engages in an aperture and/or recess when the frame portions are moved towards each other but disengages when the frame portions are moved away from each other.

In one example, the engaging portion of the locking bar can be provided with a slight or sufficient curvature (and preferably convexed curvature) on an upper surface thereof towards the apertures and/or recesses on the other frame portion to allow engagement of the same in the aperture and/or recess when the frame portions are moved together or in a first direction. A lower surface of the engaging portion of the locking bar can be angled or curved (and preferably concave in curvature) to allow release of or prevent engagement of the portion in an aperture and/or recess when the frame portions are moved apart or moved in a second direction.

A side or side edge of the engaging portion forming the taper is typically of sufficient angle (i.e. slopes upwardly towards an upper surface of the locking bar) to allow release of the engaging portion from an aperture and/or recess on rotation of the frame portions. The tapered or angled sides allow the engaging portion to slide out of the aperture and/or recess.

Preferably, a plurality of apertures and/or recesses are provided on the adjacent frame portion and the position of the apertures and/or recesses correspond to pre-determined distances with which the frame portions can be telescopically moved to.

Preferably, the frame is an outer frame and a barrier portion is provided between or within the outer frame. Further, preferably, the outer frame includes at least two substantially upright frame members and at least two substantially transverse frame members. Preferably, at least one of the substantially transverse or horizontal frame members has telescopically movable frame portions.

The barrier portion can include one or more covers, further frame members and/or the like.

Preferably, the barrier portion includes one or more substantially flexible portions to allow the barrier portion to be moved with the outer frame between the substantially erect and folded conditions. The barrier portion can cover the locking means so as to prevent a child or animal from manipulating the same to cause collapse of the barrier means when in position in a doorway or opening.

In one embodiment, user actuation means are provided on the barrier means to allow the barrier means to be moved between open and closed positions. More preferably, the user actuation means allows relative movement between at least one upright member and one transverse member to increase the ease with which the barrier means to be fitted into a required space.

Preferably, the user actuation means has a first portion joined or pivotably mounted to an end of an upright frame member and a second portion joined or pivotably mounted to an end of the transverse frame member.

The user actuation means can be moved between a closed position, wherein an end of an upright frame member is moved towards or adjacent an end of the transverse frame member, and an open position, wherein the end of the upright member is moved away or a spaced distance apart from the end of the transverse member.

Preferably, the upright member with which the user actuation means are associated includes two parts, a first part which is substantially stationary during manipulation of the user actuation means and a second part which moves relative to the stationary part on moving the user actuation means between open and closed positions.

Preferably, the user actuation means is pivotably attached to the first substantially stationary part and movement of the user actuation means about the pivot causes movement of the second part. Further, preferably, the user actuation means pushes the second part in a downwardly direction or direction remote from the user actuation means from the open to the closed positions.

In one embodiment, the first part is typically the outer frame member part and the second part is typically the inner frame member part.

In moving the user actuation means between the open and closed positions, at least one of the upright frame member parts is capable of undergoing an element of substantially vertical movement and an element of substantially horizontal movement relative to the transverse frame member or members.

The user actuation means typically includes a handle portion to move the first and second frame member parts between said open and closed positions. The user actuation means are preferably provided adjacent an upper edge of the barrier means to allow easy user access to the same and to prevent manipulation by an animal or child. However, the user actuation means could equally be provided adjacent a lower edge of the barrier means if required.

Guide means are preferably provided between the transverse and upright frame members and/or between the two parts of an upright frame member to guide the movement of the members or parts relative to each other on moving the user actuation means between the open and closed positions.

Preferably, the guide means include an angled or curved slot provided on one of the transverse or upright frame member or member parts in which a pin or protruding member on the other of the transverse or upright frame member or member parts is slidably located. This sliding movement helps to guide the movement of the frame members or frame member parts in a controlled manner on movement of the user actuation means between said open and closed positions.

In one embodiment, the angled or curved slot is provided adjacent a base of the upright member. The lower end of the angled slot is provided closest to the transverse frame member and the upper end of the angled slot is provided furthest from the transverse frame member. The pin or protruding member is provided adjacent the lower end of the angled slot when the user actuation means is in the open position and the pin or protruding member is provided adjacent the upper end of the angled slot when the user actuation means is in the closed position. As such, a part of the upright frame member is moved upwardly and outwardly or downwardly and outwardly as the user actuation means is moved from an open position to a closed position, thereby forcing an engaging surface of the upright frame member against a doorframe or border of an opening in which the barrier means is to be located. The upright frame member or member part is moved in reverse on opening of the user actuation means.

Preferably, one or more engagement or friction pads are provided at one or more positions on the upright and/or transverse frame members to allow secure engagement of the same against a suitable doorway, frame, wall, surface and/or the like.

In one embodiment, one or more friction or engagement pads are movable or movably mounted to ensure the barrier maintains secure contact against the wall during installation or following an impact during use.

Preferably, the friction or engagement pads can pivot or rock from side to side (and preferably transverse to the barrier) relative to the part of the barrier it is mounted on.

Preferably, the one or more friction pads are attached to a transverse member via attachment means, such as via a screw, and the rear surface of the pad is mounted against a protruding surface which allows the rocking movement in use.

According to a second aspect of the present invention, there is provided barrier means, the barrier means having a frame including a plurality of frame members, user actuation means provided on the barrier means to allow the barrier means to be moved between an open or disengaged position and an engaged or closed position, and wherein actuation of the user actuation means allows relative movement between at least one substantially upright frame member and at least one substantially transverse frame member to move the barrier means between the open and closed positions.

The two aspects of the present invention can be incorporated into barrier means together or independently of each other as required.

According to a further aspect of the present invention there is provided a method of using barrier means.

According to a yet further aspect of the present invention there is provided a friction pad for use with barrier means.

One method of using barrier means in which the barrier means has a frame including a plurality of frame members movable between a first substantially erect condition and a second substantially folded condition, at least one of the frame members including two or more telescopically mounted portions. The method including the steps of moving at least one of the telescopic frame members relative to the other frame member to allow expansion and/or contraction of the length of the frame member to allow the same to be fit between two required surfaces and actuating locking means associated with one or more of said frame portions to allow the portion or portions to be locked at a required length, characterized in that the locking means are actuated or moved between the unlocked and/or locked position by relative movement of the frame portion or portions with which the locking means are associated.

A further method of using barrier means in which the barrier means has a frame including a plurality of frame members, user actuation means provided on the barrier means to allow the barrier means to be moved between an open or disengaged position and an engaged or closed position, and wherein the method includes the step of actuating the user actuation means to allow relative movement between at least one substantially upright frame member and at least one substantially transverse frame member to move the barrier means between said open and closed positions.

BRIEF DESCRIPTION OF THE DRAWINGS

Embodiments of the present invention will now be described with reference to the accompanying figures.

DETAILED DESCRIPTION OF THE INVENTION

Figure 1A:
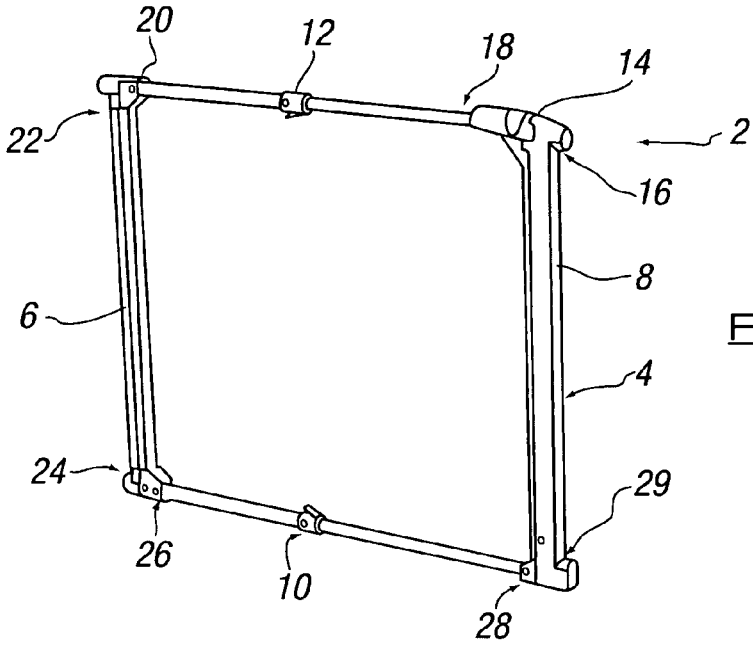
FIGS. 1*a*-1*c* illustrate erect, intermediate and folded conditions of barrier means respectively according to the present invention in one example without the barrier portion shown.
Figure 1B:
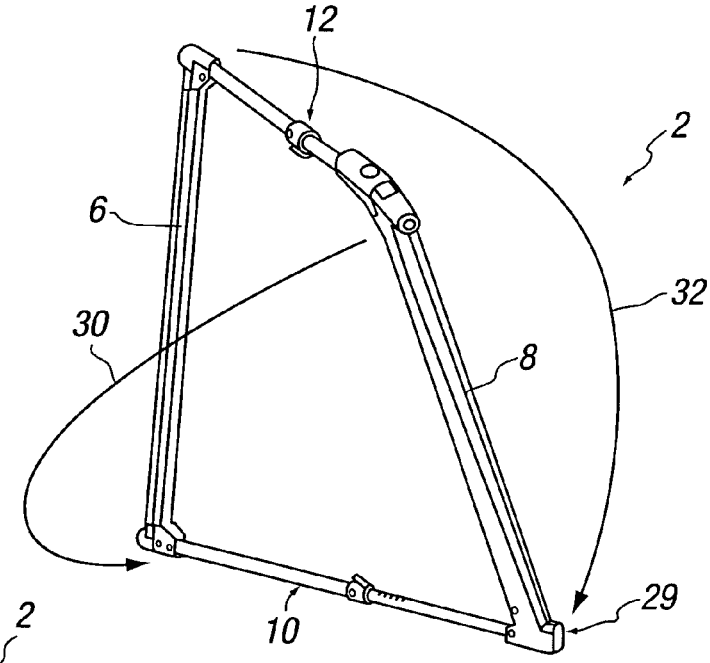
Figure 1C:
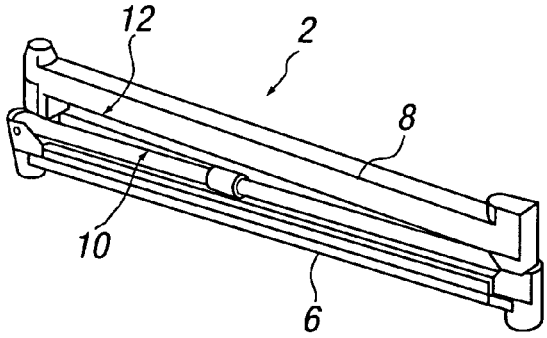

Referring firstly to FIGS. 1*a*-1*c*, there is illustrated barrier means in the form of a child safety gate 2. The gate 2 is capable of moving between an erect "in-use" condition, shown in FIG. 1*a*, to a partially folded condition, shown in FIG. 1*b*, to a folded condition, shown in FIG. 1*c*.

Gate 2 includes an outer frame 4 with a barrier portion (not shown) provided between the outer frame. The barrier portion is typically in the form of netting or fabric attached between the outer frame which is substantially flexible to allow movement with the outer frame between the erect and folded conditions. The barrier portion can be detachably attached to the outer frame, fixedly attached or integrally formed therewith.

Outer frame 4 includes four frame members; two substantially upright frame members 6, 8 and two further frame members 10, 12 which are located substantially transverse or perpendicular to the upright frame members. In the erect condition, the two upright frame members 6, 8 are a spaced distance apart and substantially parallel to each other and the two transverse frame members are a spaced distance apart and substantially parallel to each other.

User actuation means 14 are provided between an end 16 of upright frame member 8 and an end 18 of transverse frame member 12 and the user actuation means is pivotably mounted to each frame member 8, 12 as will be described in more detail below.

An opposite end 20 of frame member 12 is pivotably mounted to an end 22 of upright frame member 6. The opposite end 24 of frame member 6 is pivotably attached to an end 26 of transverse frame member 10. The opposite end 28 of frame member 10 is pivotably mounted to an end 29 of frame member 8.

Since each end of the frame members forming the outer frame is pivotably mounted to an adjacent frame member, the frame members can be rotated relative to each other to allow folding of the same. More particularly, upper transverse member 12 is typically moved through a substantially helical or twisting path, as shown by arrows 30, 32 in FIG. 1*b*, until it is substantially parallel and adjacent upright frame members 6, 8 and lower transverse member 12.

Figure 2A:
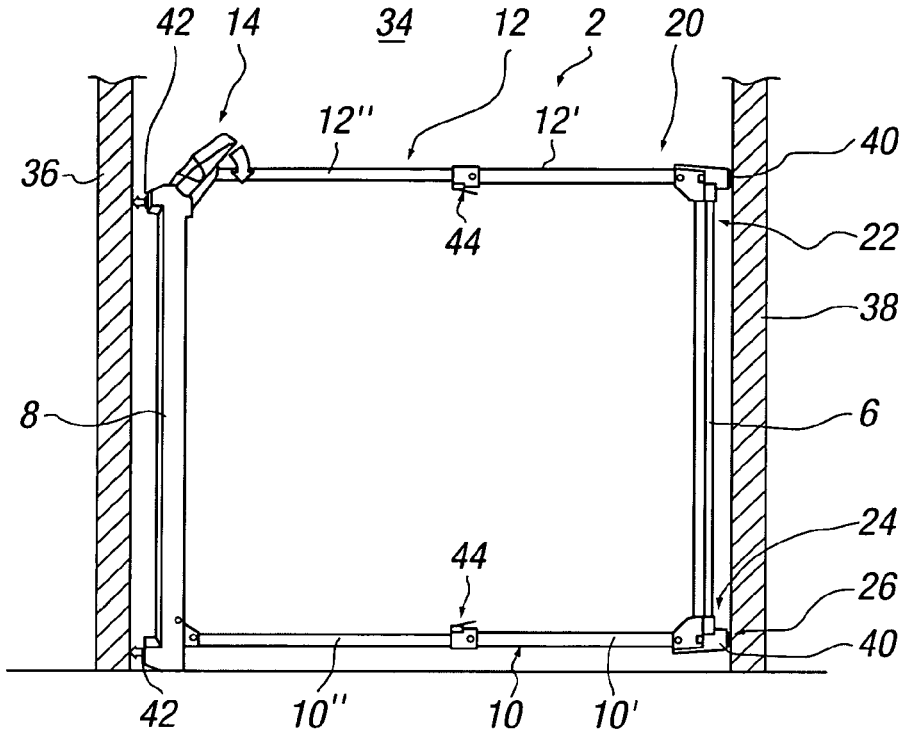
FIGS. 2*a*-2*b* illustrate the barrier means located in a doorway with the user actuation means in an open position and closed position respectively.
Figure 2B:
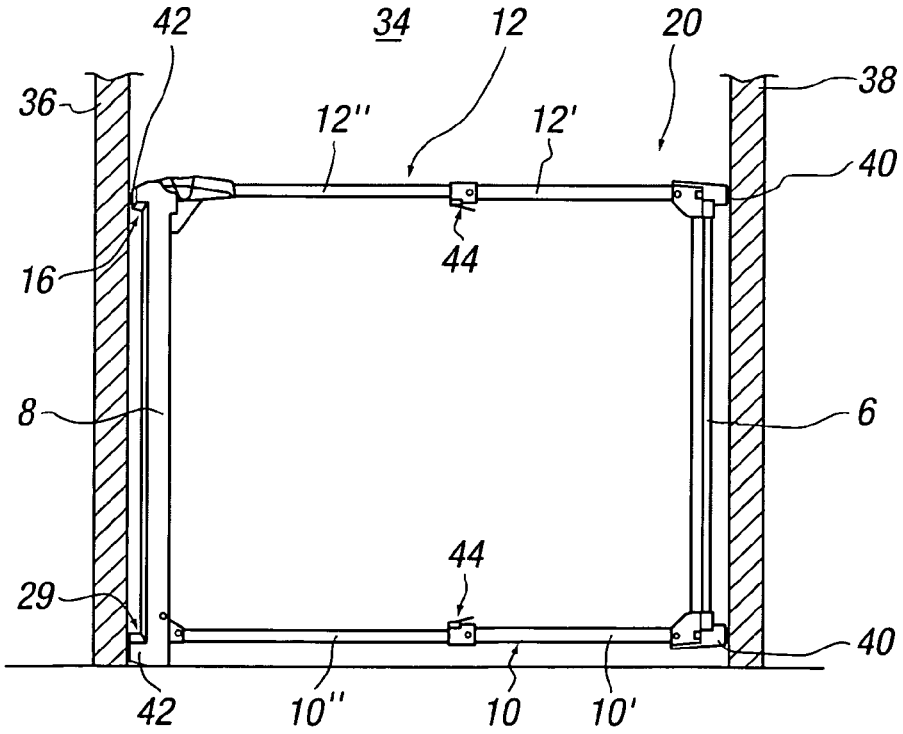

Referring to FIGS. 2*a* and 2*b*, gate 2 is illustrated in use in a door way 34 defined between two spaced apart door frame members 36, 38. Engagement pads 40 are located on the sides of upright member 6 adjacent ends 22, 24. These engagement pads engage against door frame 38 in use. Engagement pads 42 are also provided on the side of upright member 8 adjacent ends 16, 29 thereof. Engagement pads 42 are moved into engagement against door frame 36 in use using user actuation means 14 as described in more detail below.

Each frame members 10, 12 comprises two frame portions 10', 10" and 12', 12". FIGS. 4*a*-4*d* illustrate one example of frame portions 10', 10". At least frame portions 10', 12' are hollow and are of larger dimensions than frame portions 10", 12" which are telescopically or slidably mounted therein respectively. Locking means 44 are located adjacent end 46 of frame portion 10' and include a sleeve 48 located over end 46 and a locking bar 50 pivotably mounted between two supports 52 on the sleeve.

Locking bar 50 has a first end 54 and a second opposite end 56. End 56 has a narrowing taper to form an engaging hook for location in one of a plurality of apertures 58 provided at spaced apart intervals on frame portion 10". End 54 of locking bar 50 is resiliently biased by spring 60 away from sleeve 48. The biasing force of spring 60 causes end 56 to pivot towards frame portion 10" for engagement in an aperture 58 if aligned therewith.

Figure 4A:
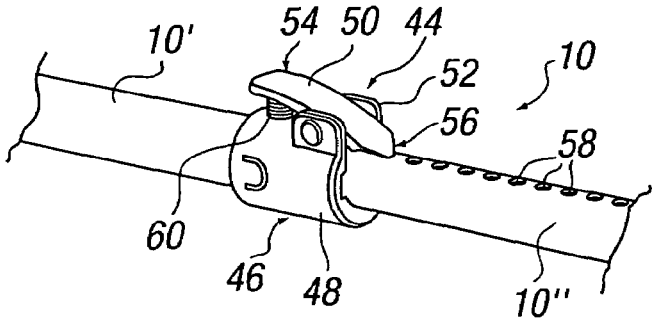
FIGS. 4*a*-4*d* illustrate different positions of the locking bar of the frame portions.
Figure 4B:
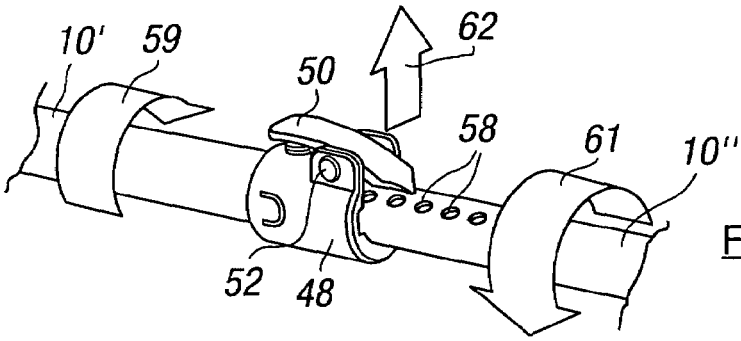
Figure 4C:
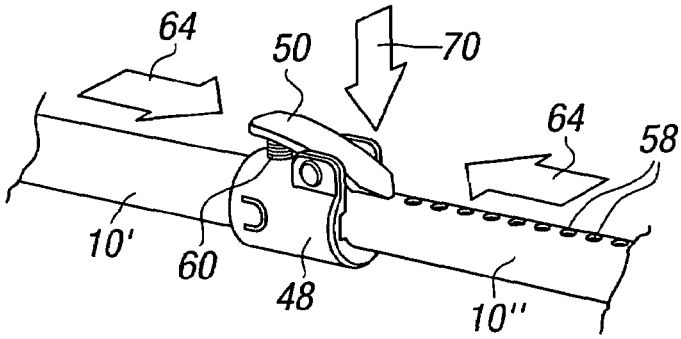
Figure 4D:
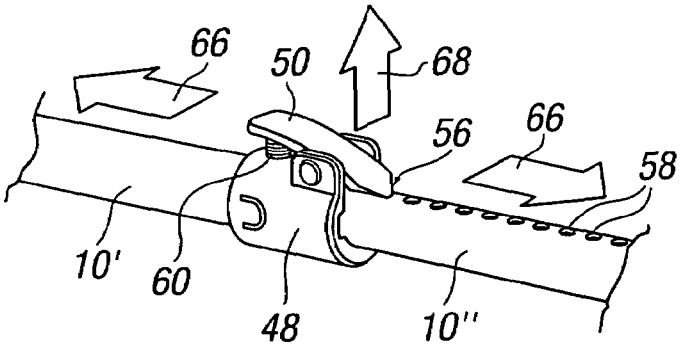

Relative rotation of frame portions 10', 10", as shown by opposing arrows 59,61 causes tapered end 56 of locking bar 50 to rise up out of an aperture 58 in which it is engaged, as shown by arrow 62, to allow unlocking of said locking bar therewith, as shown in FIG. 4*b*. With the locking bar unlocked, frame portions 10', 10" can be moved between an extended position, wherein the frame portions are telescopically pulled away from each other, as shown by arrows 66 in FIG. 4*d*, and a contracted position, wherein the frame portions are telescopically pushed together, as shown by arrows 64 in FIG. 4*c*.

Due to the shape of the tapered end 56 of locking bar 50 having a slight curvature towards frame portion 10", when frame portions 10', 10" are pulled away from each other, end 56 is raised, as shown by arrow 68 and does not engage in apertures 58 on portion 10" until movement has stopped and end 56 has been aligned with a suitable aperture 58. When frame portions 10', 10" are pushed towards each other, end 56 is lowered, as shown by arrow 70 and engages in an aperture 58 when aligned therewith.

Thus, the length of transverse members 10, 12 can be adjusted simply by pulling or pushing the relative frame portions together and/or apart. This relative movement is sufficient to cause said locking bar to be moved between locked and unlocked positions without any further user manipulation required. It will be appreciated that in addition to relative movement of the frame portions, a user can also still depress end 54 of locking bar 50 if required, thereby overcoming the biasing force of spring 60 to cause locking bar 50 to move between locked and unlocked positions. However, self releasing/self locking of the locking means is preferred due to it freeing the user's hands for supporting the gate. The user can adjust the gate width by holding the upright members and separating them, pushing them together and/or rotating the same to allow movement of the transverse frame portions.

Referring to FIGS. 3*a*-3*e*, frame member 8 comprises two parts; an inner part 8', and an outer part 8" which are movable relative to each other. The longitudinal axis of parts 8' and 8" are substantially parallel and adjacent to each other. Outer part 8' is typically substantially stationary during manipulation of the user actuation means 14. Inner part 8' is slidably movable on actuation of the user actuation means relative to outer part 8" and transverse frame portions 10", 12". Inner part 8' is also hingedly connected to transverse frame portions 10" and 12" via joints 87, 89.

More specifically, user actuation means 14 has a first portion 72 pivotably attached to end 16 of outer frame part 8" and a second portion 74 pivotably attached to end 18 of transverse frame portion 12". A handle portion 76 joins the first and second portions 72, 74 together. With the user actuation means 14 in an open position, such that handle 76 is raised above and a spaced distance apart from frame portion 12" and end 18 of transverse frame portion 12" is a spaced distance apart from end 16 of outer frame part 8", as shown in FIG. 3*a*, and end of outer frame member part 8" is lower than an end of lower frame portion 10".

Figure 3A:
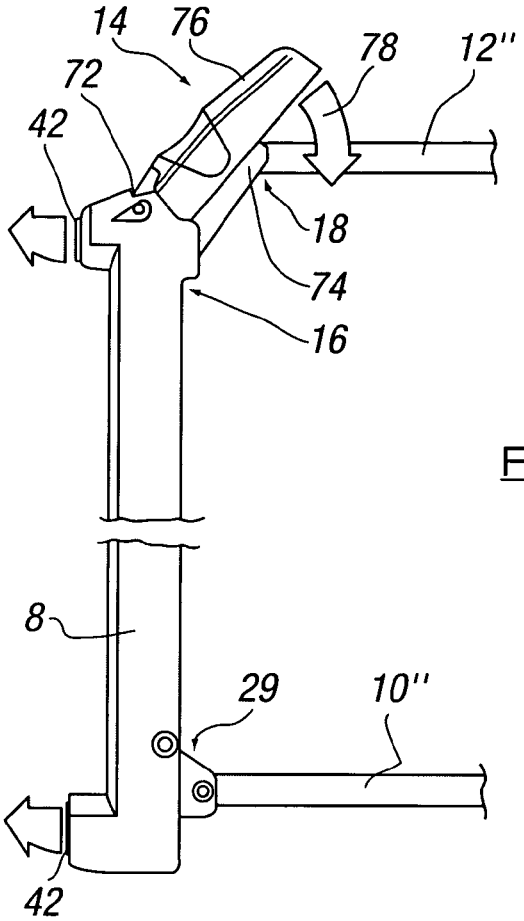
FIGS. 3*a*-3*b* illustrate a more detailed view of the user actuation means in an open condition and closed position respectively.
Figure 3B:
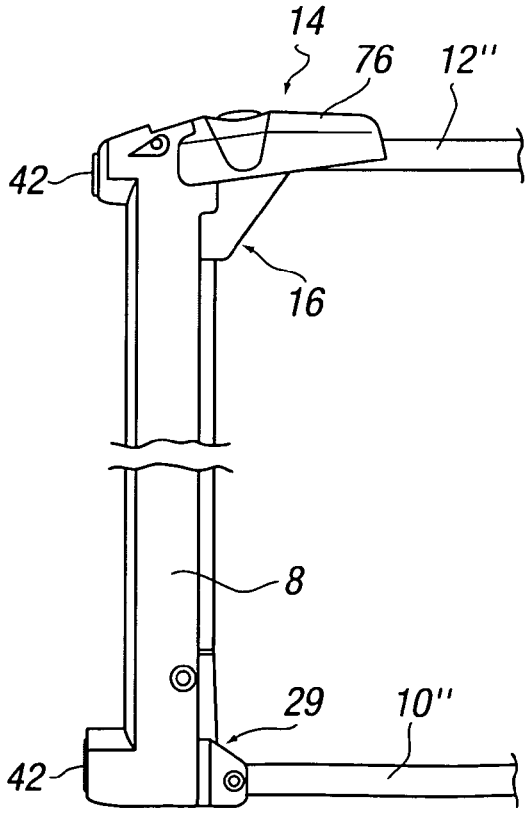
Figure 3C:
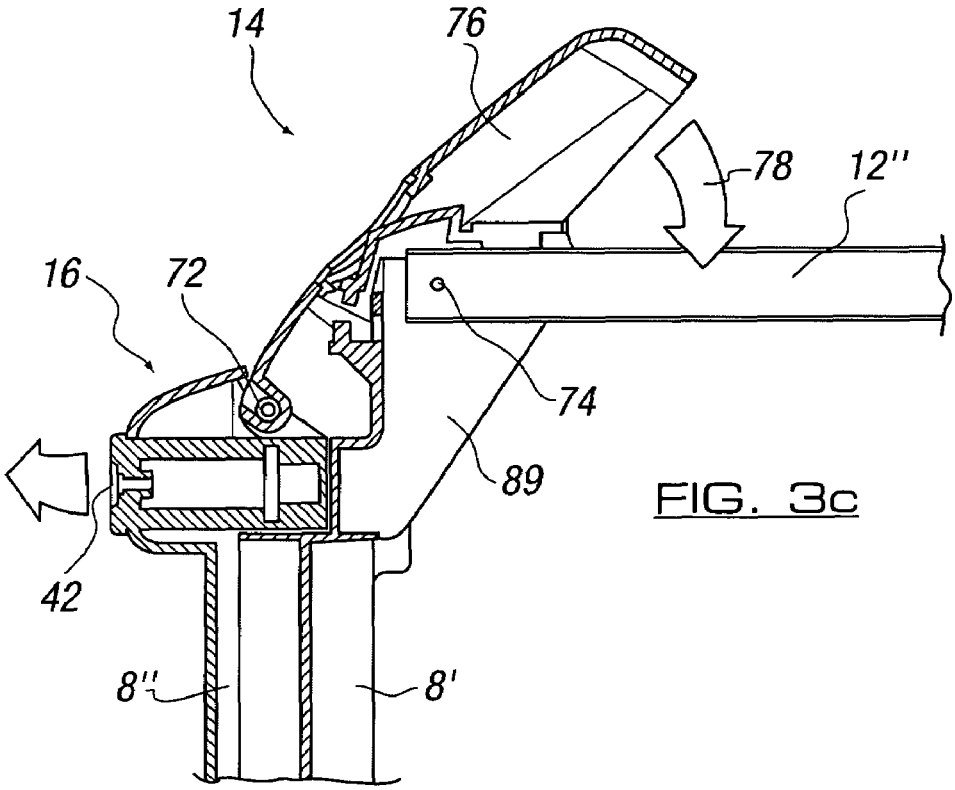
FIGS. 3*c*-3*d* illustrate cross-sectional views of the user actuation means in FIGS. 3*a* and 3*b* respectively.
Figure 3D:
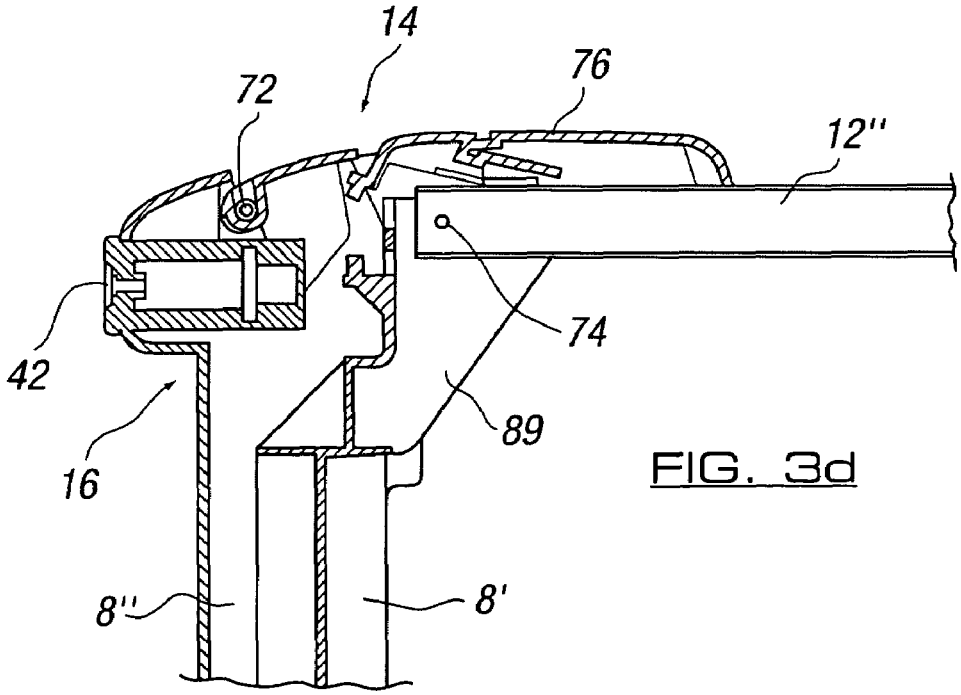
Figure 3E:
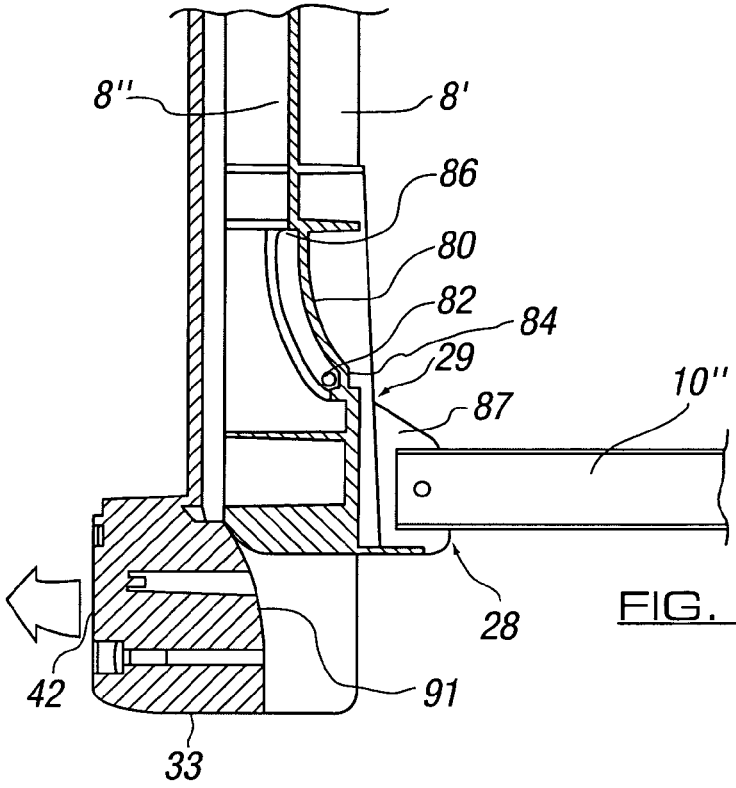
FIGS. 3*e*-3*f* illustrate cross-sectional views of the base of the barrier means when the user actuation means are in the open and closed positions respectively.

The user actuation means 14 can be moved to a closed position by moving or lowering handle portion 76 towards upper frame portion 12", as shown by arrow 78 in FIG. 3*a*. This causes lower end 29 of inner frame member part 8' to move downwardly towards end 33 of outer frame member part 8". Frame portion 10" follows the movement of inner frame part 8'. This in turn causes engagement pads 42 to be engaged firmly against the door frame to lock the gate in position within the door frame.

Figure 3F:
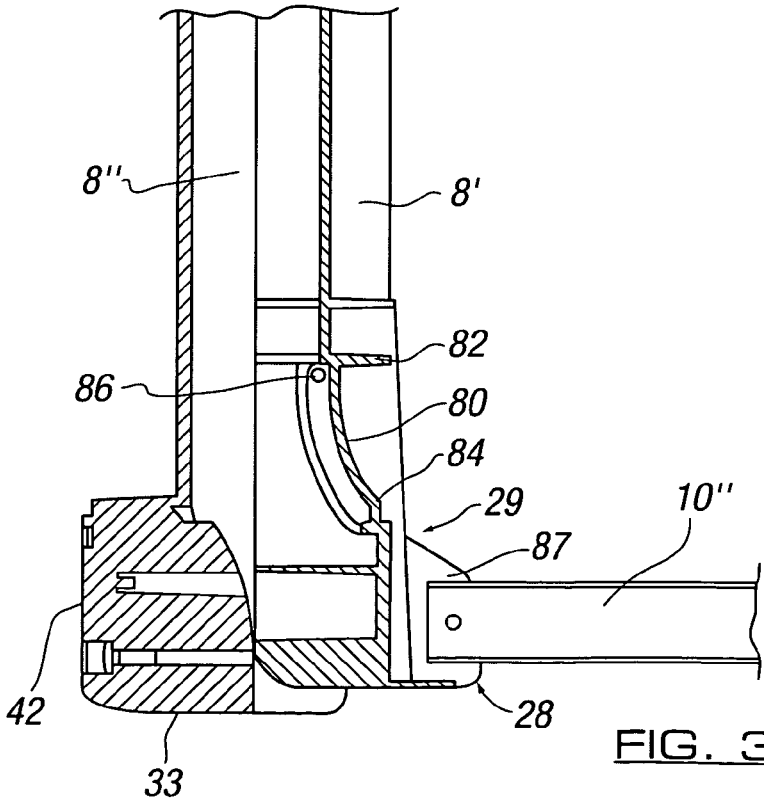

Guide means in the form of an angled and curved slot 80 is provided adjacent end 29 of stationary upright outer frame member part 8" in which a pin 82 provided on movable inner frame member part 8' is slidably engaged. Lower end 84 of slot 80 is provided closest to frame portion 10" and upper end 86 of slot 80 is provided furthest from frame portion 10". As such, when the user actuation means are moved from an open position, shown in FIG. 3*e*, wherein pin 82 is located at lower end 84 of slot 80, to a closed position, shown in FIG. 3*f*, wherein pin 82 is located at upper end 86 of slot 80, friction pad 42 on upright frame member 8" is moved towards the doorframe to secure the frame in said doorframe. This is as a result of inner frame part 8' being moved downwardly and against end 33 of outer frame part 8".

Outer upright frame part 8" is provided with a curved or convexed outer surface 91 adjacent and facing lower end 29 of inner frame part 8'. The lower end 29 of frame part 8' slides over this convexed outer surface on movement of the user actuation means, thereby applying an increased transverse force parallel to frame 10" against pad 42 when the user actuation means is in a closed position, and reducing this transverse force against pad 42 when the user actuation means is in an open position. Thus, in an open position, end 29 of inner frame part 8' is above and closer to pad 42 than when in the closed position, where end 29 of part 8' is substantially parallel to and further apart from pad 42.

Thus, at least one of the upright frame members includes two parts which are movable relative to each other in such a manner so as to expand or contract the width of said upright frame member. Expansion of the width of the barrier bridges any gap present between the outer surface of the upright frame member and the door frame to which the outer surface of the frame member is to engage in use, thereby allowing securing engagement of the gate in the gap. Guide means are provided on the upright member parts to guide the relative movement of the parts in a controlled manner.

Thus, in use of the gate of the present invention, a user adjusts the length of transverse frame members 10, 12 to approximately the correct length for fitting between the door frame simply by pulling, pushing or rotating the frame member portions relative to each other. Once the gate is located in the required space in which it is to be fitted, the user then moves the handle portion 76 from an open position to a closed position, thereby engaging engagement pads 42 against the door frame defining the opening and closing any gap between the door frame and the gate. Any vertical pressure applied to the gate causes the locking bar to increase engagement with the apertures/recesses.

The engagement pads can be any suitable substantially deformable member which allows frictional engagement between the same and a surface of a door frame, wall and/or the like.

Figure 5A:
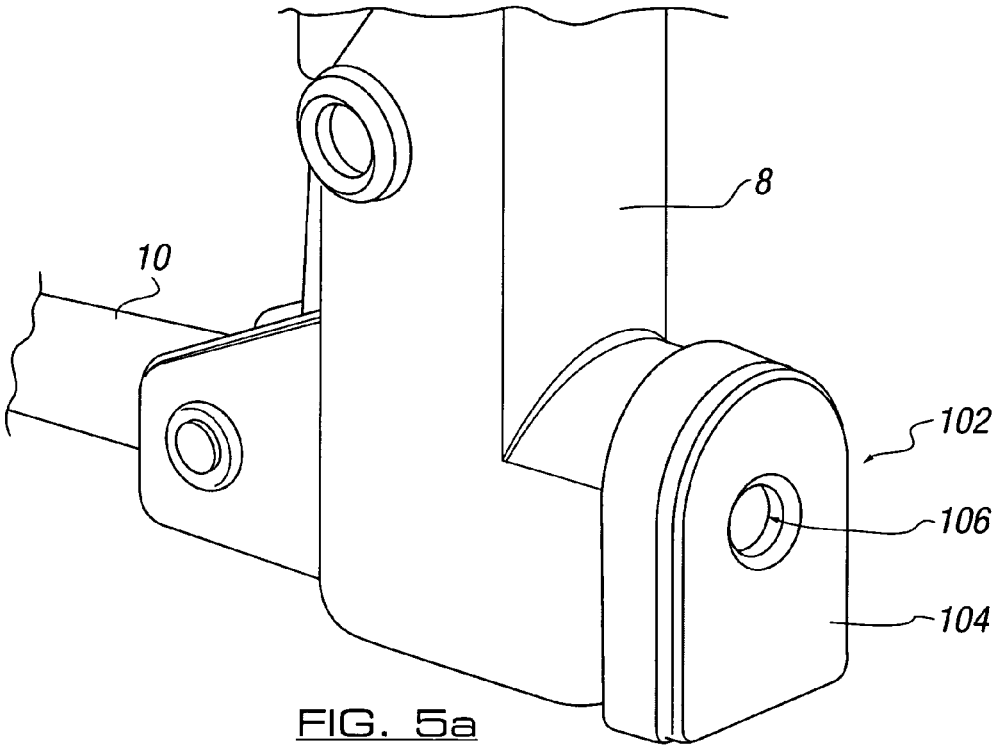
FIGS. 5*a* and 5*b* illustrate a perspective view and cross-sectional view respectively of a friction pad in one embodiment of the present invention.
Figure 5B:
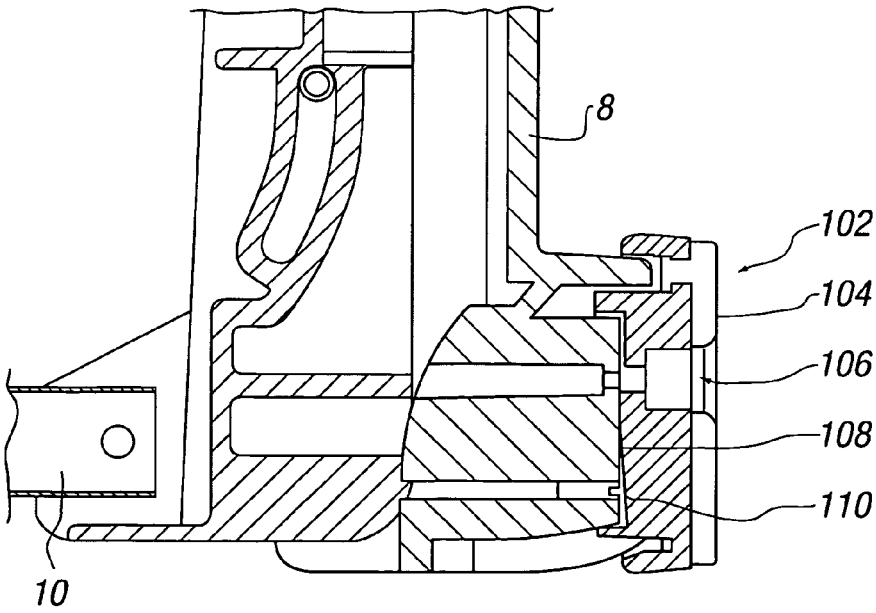

Referring to FIGS. 5*a* and 5*b*, there is illustrated an example of a friction pad 102 for use with the present invention. The pad 102 includes a substantially planar or flat outer surface 104 and an aperture 106 located therethrough for the attachment of a screw to upright frame member 8. A protruding ridge 108 arranged longitudinally of frame member 8 is located against a rear surface 110 of pad 102 and pad 102 can rock or pivot about the ridge 108 to ensure firm contact between outer surface 104 and a wall to which the barrier is secured to in use.

The gate can be formed from any suitable material and can be of any suitable shape, size and/or design. The gate is preferably formed from lightweight material to allow easy manipulation and transportation of the barrier means.

Thus, the present invention provides collapsible barrier means which can be easily manipulated to allow the same to be moved between a folded condition and an erect condition for easy transportation and storage.

The invention claimed is:

1. A barrier means, said barrier means comprising:

a frame including a plurality of pivotally connected frame members movable between a first substantially erect condition and a second substantially folded condition, at least one of said frame members including two or more telescopically mounted portions capable of relative movement to allow expansion and/or contraction of the length of the frame member;

locking means associated with one or more of said frame portions to allow the portion or portions to be locked at a required length, the locking means are movable between a locked and/or unlocked position by relative movement of the frame portion or portions with which the locking means are associated;

actuation means located on said barrier means for moving said barrier means between an open position and a closed position, and wherein in the closed position an end of an upright frame member is moved towards or adjacent to an end of a transverse frame member, and in the open position the end of the upright frame member is moved a spaced distance apart from the end of the transverse frame member; and guide mechanisms provided between parts of an upright frame member to guide movement of the parts of the frame member on actuation of the actuation means, the guide mechanisms further including, an angled or curved slot being provided on one of the upright frame member parts and being adjacent a base of the upright member, a lower end of the slot being provided closest to the transverse frame member and an upper end of the slot being provided furthest from the transverse frame member, and a protruding member or pin being located on the other of the frame member parts being slidably located in the slot, the protruding member or pin being located at the lower end of the slot when the barrier is in an open position and is movable to the upper end of the slot when the barrier is in a closed position.

2. The barrier means according to claim 1 wherein said locking means is self released and/or self locked by applying a minimum pre-determined level of force to relatively move the frame portion or portions.

3. The barrier means according to claim 1 wherein the frame portions undergo relative rotational movement to self release and/or self lock said locking means.

4. The barrier means according to claim 1 wherein the frame portions undergo relative sliding movement to self release and/or self lock said locking means.

5. The barrier means according to claim 1 wherein said locking means includes a locking bar provided on or associated with one of the frame portions, at least a part of which engages in a recess or aperture located on or associated with another adjacent frame portion.

6. The barrier means according to claim 5 wherein said locking bar is provided on or associated with an outer frame portion having larger dimensions than an inner frame portion telescopically mounted in said outer frame portion, the inner frame portion having one or more apertures or recessed located on or associated therewith.

7. The barrier means according to claim 5 wherein said locking bar is pivotably mounted on the frame portion to allow pivotable movement of said locking bar between locked and unlocked positions.

8. The barrier means according to claim 1 wherein said locking means is resiliently biased to a locked position.

9. The barrier means according to claim 5 wherein said locking bar is pivotably mounted on an outer frame portion and has a first end which engages with an aperture defined on an inner frame portion which is telescopically mounted in said outer frame portion, and an opposite end which has a resiliently biasing force acting thereon to bias said locking bar to an engaged position.

10. The barrier means according to claim 5 wherein the engaging part of said locking bar has a narrowing taper for engaging in the recess or aperture of the adjacent frame portion.

11. The barrier means according to claim 5 wherein an outer surface of said locking bar is substantially convexed or outwardly curved in shape and an inner surface of said locking bar is substantially concave or inwardly curved in shape to allow preferential engagement of said locking bar when moved in at least a first direction.

12. The barrier means according to claim 5 wherein side edges of the engaging part of said locking bar slope upwardly towards an upper surface of said locking bar.

13. The barrier means according to claim 5 wherein a plurality of spaced apart apertures or recesses are defined in the frame portion and correspond to pre-determined positions which the frame portions can be telescopically moved.

14. The barrier means according to claim 1 wherein said frame is an outer frame and a barrier portion is provided between or within said outer frame.

15. The barrier means according to claim 1 wherein an outer frame includes at least two substantially upright frame members and at least two substantially transverse frame members.

16. The barrier means according to claim 15 wherein at least one of the substantially transverse or horizontal frame members has telescopically movable frame portions.

17. The barrier means according to claim 14 wherein said barrier portion includes one or more substantially flexible portions and the flexible portion can move with said outer frame between said substantially erect and folded conditions.

18. The barrier means according to claim 14 wherein said barrier portion covers said locking means in use.

19. The barrier means according to claim 1 wherein the actuation means has a first portion pivotably mounted to an end of an upright frame member and a second portion pivotably mounted to an end of a transverse frame member.

20. The barrier means according to claim 1 wherein the actuation means is associated with said upright frame member and said frame member includes said at least two members; a first member which is substantially stationary during actuation of the actuation means and a second member which moves relative to said first member on actuation of the actuation means.

21. The barrier means according to claim 20 wherein the actuation means is pivotably attached to a first substantially stationary member and movement of the actuation means about the pivot moves said second member relative to the first member.

22. The barrier means according to claim 21 wherein the actuation means pushes said second member in a downwardly direction or towards an end remote from the actuation means from an open to a closed position.

23. The barrier means according to claim 20 wherein said first member is an outer member of said upright frame member and said second member is an inner member of said upright frame member.

24. The barrier means according to claim 20 wherein the movable upright frame member undergoes an element of substantially horizontal movement and an element of substantially vertical movement when moving the user actuation means between open and closed positions.

25. The barrier means according to claim 1 wherein one or more friction or engagement pads are provided on one or more ends of said frame members to allow secure engagement of the barrier means against a suitable surface in use.

26. The barrier means according to claim 25 wherein said one or more friction or engagement pads are movable relative to the frame member to which they are attached.

* * * * *

UNITED STATES PATENT AND TRADEMARK OFFICE

CERTIFICATE OF CORRECTION

PATENT NO. : 7,658,220 B2
APPLICATION NO. : 11/599805
DATED : February 9, 2010
INVENTOR(S) : Adam Yates It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 338 days.

Signed and Sealed this

Thirtieth Day of November, 2010

David J. Kappos

David J. Kappos
*Director of the United States Patent and Trademark Office*